United States Patent [19]

Goller et al.

[11] 4,454,731

[45] Jun. 19, 1984

[54] KNITTED FABRIC SPREADER DEVICE FOR FLAT KNITTING MACHINES

[75] Inventors: Ernst Goller, Reutlingen; Günther Kazmaier, St. Johanna-Ohna; Hermann Schmodde, Albstadd, all of Fed. Rep. of Germany

[73] Assignee: H. Stoll GmbH & Co., Reutlingen, Fed. Rep. of Germany

[21] Appl. No.: 469,973

[22] Filed: Feb. 25, 1983

[30] Foreign Application Priority Data

Mar. 2, 1982 [DE] Fed. Rep. of Germany ..... 3207355

[51] Int. Cl.[3] ..... D04B 15/88

[52] U.S. Cl. ..... 66/149 R; 66/150

[58] Field of Search ..... 66/149 R, 152, 150

[56] References Cited

U.S. PATENT DOCUMENTS 2,486,179 10/1949 Kuehnel ..... 66/150 R
3,269,150 8/1966 Haehnel ..... 66/149 R
3,618,343 11/1971 Essig ..... 66/149 R
4,359,881 11/1982 Baseggio et al. ..... 66/152

*Primary Examiner*—Ronald Feldbaum
*Attorney, Agent, or Firm*—Larson and Taylor

[57] ABSTRACT

This invention relates to a knitted fabric spreader device for flat knitting machines which have spiked rotatable rollers (14) disposed beneath the comb gap (12) of the needle beds of the machine. The spiked rollers (14) are mounted over the full length of the needle beds (10, 11) on a common carrier rod (13) concentric with this rod, and the common carrier rod (13) can be moved transversely to the longitudinal direction of the needle beds to provide for clearance of the comb gap (12) of the machine. To cater for this adjustment the carrier rod (13) is held on at least slides adjustable by means of a control cam (27). The rollers (14) are so mounted between eccentric intermediate discs (15) provided with a smooth peripheral edge that spikes (38) of the rollers (14) project radially above the intermediate discs (15) over a part only of the carrier rod (13) to engage the knitted fabric (29) (FIG. 2).

8 Claims, 5 Drawing Figures

KNITTED FABRIC SPREADER DEVICE FOR FLAT KNITTING MACHINES

The invention relates to a knitted fabric spreader device for flat knitting machines, comprising spiked rotatable rollers arranged beneath the comb gap of the needle beds and by means of which the knitted fabric can be taken down by the take-down device of the machine.

Fabric spreader devices of the kind set forth above are already known for preventing contraction of the knitted fabric, these being arranged at the edges of the knitted fabric and provided with obliquely arranged rotatable conical wheels provided with hard steel tips and intended by the rolling of these wheels, to draw off the edges of the fabric outwards. These fabric spreader devices are stationary and can only be put into action after the fabric has been taken off. After each thread breakage they have to be removed, with the deposited fabric so that the latter can be lifted again. They also have to be removed when pins of the take-down mechanism is brought into action, and moreover they obstruct the use of strippers. Since the spiked rollers can only reach a predetermined length and exercise their spreading over effect in one specific direction their use in the manufacture of shaped fabrics, in particular during the production of a number of shaped knitted parts one beside another, is practically impossible on a flat knitting machine.

The object of the present invention is to provide a knitted fabric spreader device having spiked rollers of such form that they can perform the withdrawal also of shaped knitted parts and, as required, rapidly from the area beneath the comb gap of a flat knitting machine.

This object is met in the present invention by the use of a knitted fabric spreader device of the type set forth above in which the spiked rollers are arranged over the full length of the needle bed on a common carrier rod which, for the purpose of opening the comb gap of the machine, are arranged for adjustment on the frame of the needle beds transversely to the longitudinal direction of the needle beds. The spiked rollers may preferably be mounted on the carrier rod coaxially between eccentric smooth spacer discs, or eccentrically between coaxial smooth spacer discs, in such a way that the spikes of the rollers project beyond the spacer discs over a part only of the periphery to engage the fabric.

Experiments have shown that to achieve an adequate spread width of the knitted fabric or of the knitted products an oblique disposition of the spiked rollers is not necessary. The coaxially-arranged spiked rollers act over the complete length of the needle beds of the machine and in the same way on a knitted product made singly or plurally on the machine. By virtue of the eccentric arrangement of the spiked rollers or of the smooth intermediate discs the result is achieved that the spikes of the rollers, after passage through a specific take-down stretch, escape behind the smooth edges of the intermediate discs and consequently withdraw again from the knitted fabric. The intermediate discs between the spiked rollers thus act as strippers which prevent the knitted fabric being caught on the spiked rollers.

Because of the adjustable arrangement of the carrier rod and its spiked rollers the fabric spreader elements can, as required, be distanced from the area beneath the comb gap of the machine so that during shaped knitting single strippers can be applied without obstruction, and lifting of the fabric which drops after breakage of the yarn can be effected without obstruction; even withdrawal hooks can be used and guided upwards through the comb gap of the machine. For the purpose of adjustment the carrier rod can be held on at least two slides each of these being moved by a control cam for effecting the adjustment transversely to the longitudinal direction of the needle beds. The adjusting part of the spreader device may have a longitudinally displaceable changeover rod coupled with a driving unit which is provided in the vicinity of each of the slides with a cursor to which the control cam for the transverse adjustment is suited.

Adaption of the spreader device to the shape and to the number of shaped knitted parts made simultaneously on the flat knitting machine is not necessary. The spreader device participates (wholly or in part) in the racking of the needle beds, and to cater for this the control cam, with advantage, have an inactive section parallel to the longitudinal direction of the needle beds and of a length at least equal to the maximum length through which the needle beds can be racked. Hereafter an embodiment of a knitting spreader device according to the invention will be described with reference to the accompanying more or less diagrammatic drawings.

Figure 1:
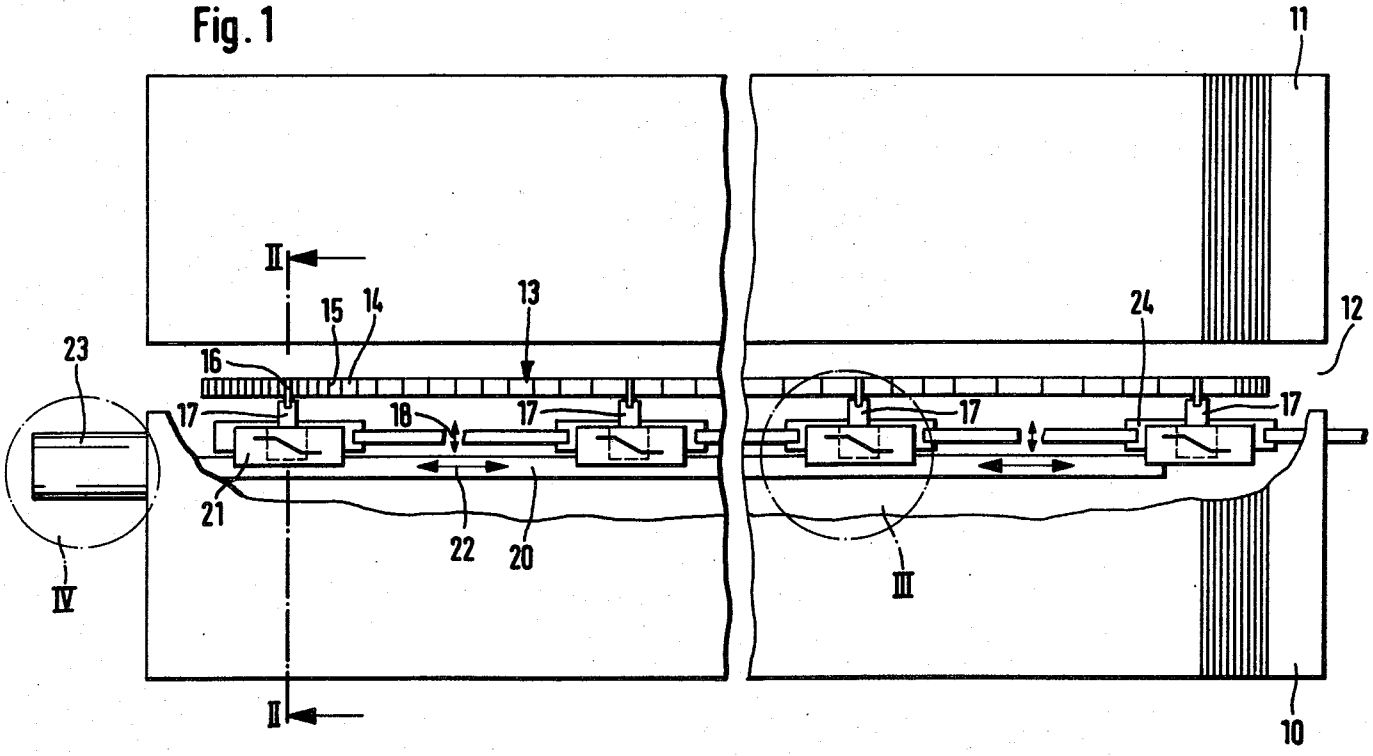
FIG. 1 is a diagrammatic plan view of a flat knitting machine incorporating the knitting spreader device.
Figure 2:
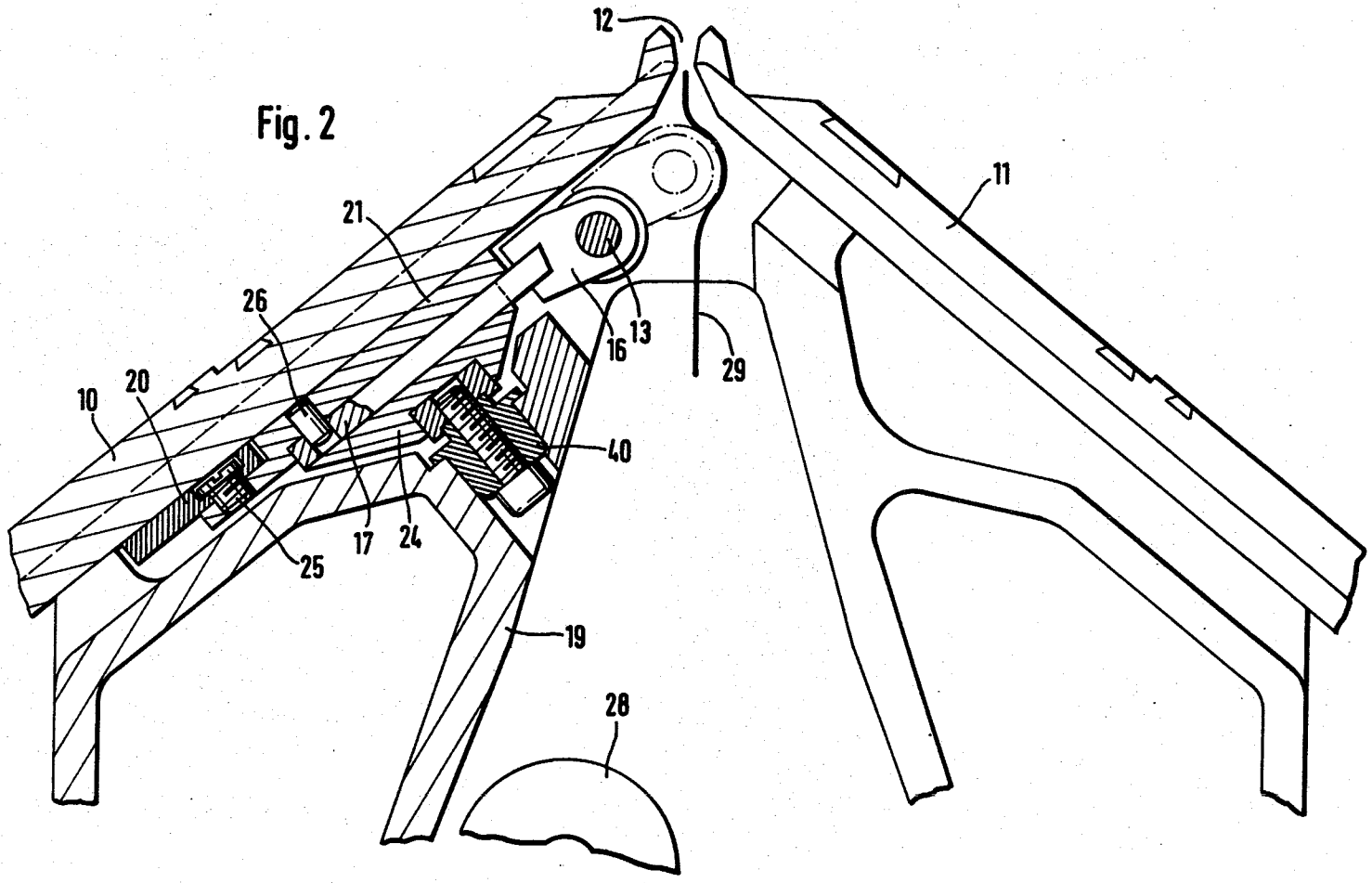
FIG. 2 is a part cross section through the machine on the line II—II of FIG. 1, shown on a larger scale than that of FIG. 1.

The diagrammatic FIG. 1 shows the rear needle bed 10 and front needle bed 11 of a flat knitting machine having a comb gap 12 between the two needle beds. Outside the outline of the two needle beds 10 and 11 only the main portions of the knitting spreader device have been shown, namely a carrier rod 13 extending over the full length of the needle beds 10, 11 and having spiked rollers 14 and spacer discs 15 threaded thereon in alternation, which rollers and discs are described later in more detail in reference to FIG. 5. The carrier rod 13 in the example illustrated is connected through four retaining arms 16 having a slide 17 which is displaceable on the needle bed support frame 19 of the rear needle bed 10 in the directions of the double arrow 18 transversely to the longitudinal direction of the carrier rod 13 and the needle beds 10, 11 (FIG. 2). All four slides 17 can be simultaneously adjusted by means of a common changeover rod 20 being coupled to this rod in each case through a cursor 21. The changeover rod extends parallel to the carrier rod 13 and can be shifted longitudinally in the directions of the double arrow 22 indicated by means of an operating unit 23.

FIG. 2 gives a cross sectional view through the needle bed support frame 19 in the area of one of the slides 17 of the adjusting part of the spreader device. The sectional picture shows a retaining arm 16 with which the carrier rod 13 and a slide 17 are connected, this slide arranged in a bearing 24 anchored to the needle bed 10. Engaged with the bearing 24 is an element 40 for heightwise adjustment of the needle bed 10. This sectional illustration also shows the changeover rod 20 to which the cursor 21 is connected by fastening screws 25. The slide 17 is provided with a guide pin 26 engaging in a control slot 27 of the cursor 21 seen in FIG. 3. FIG. 2 shows in full line the carrier rod 13 in a position in which it has been withdrawn from beneath the comb gap 12 of the flat knitting machine. In dotted lines it is shown in its position ready for operation in which it is disposed beneath the comb gap 12 of the machine, and also shown is the knitted fabric 29 drawn off by the take-down roller 28 of the take-off device of the flat knitting machine and conducted over the spiked rollers 14.

Figure 3:
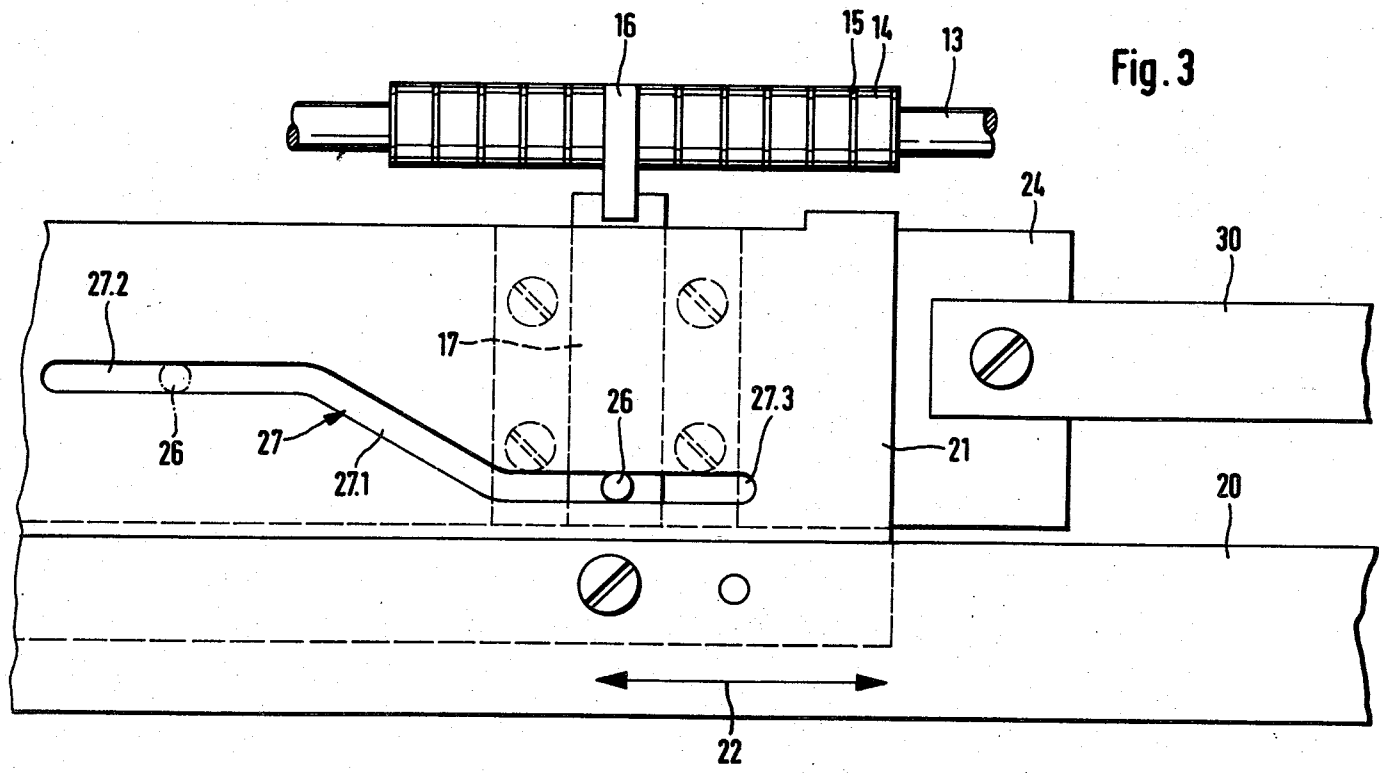
FIG. 3 is a fragmental illustration of the area III of the spreader device of FIG. 1.

FIG. 3 depicts the fact that the control slot 27 in the cursor 21, which is of plate form has a central, oblique active part 27.1 and two end parts 27.2 and 27.3 extending parallel to the carrier rod 13 and to the changeover rod 20 and also to the longitudinal direction of the needle beds of the flat knitting machine. The length of the two parallel end parts 27.2 and 27.3 approximate at least to the length of the complete racking length by which the rear needle bed 10, on which the slide 17 is mounted, can be adjusted relatively to the needle bed support frame 19 on which the changeover rod 20 with the slides 21 is mounted. The guide pins 26 of the slide 17 in the two end areas 27.1 and 27.2 of the control slot 27 are shown in the position which they assume in the normal situation of the rear needle bed 10, that is to say when the needle bed 10 has not been racked either to the left or to the right. The racking bar 30 of the racking device of the machine connected to the needle bed is depicted in FIG. 3.

Figure 4:
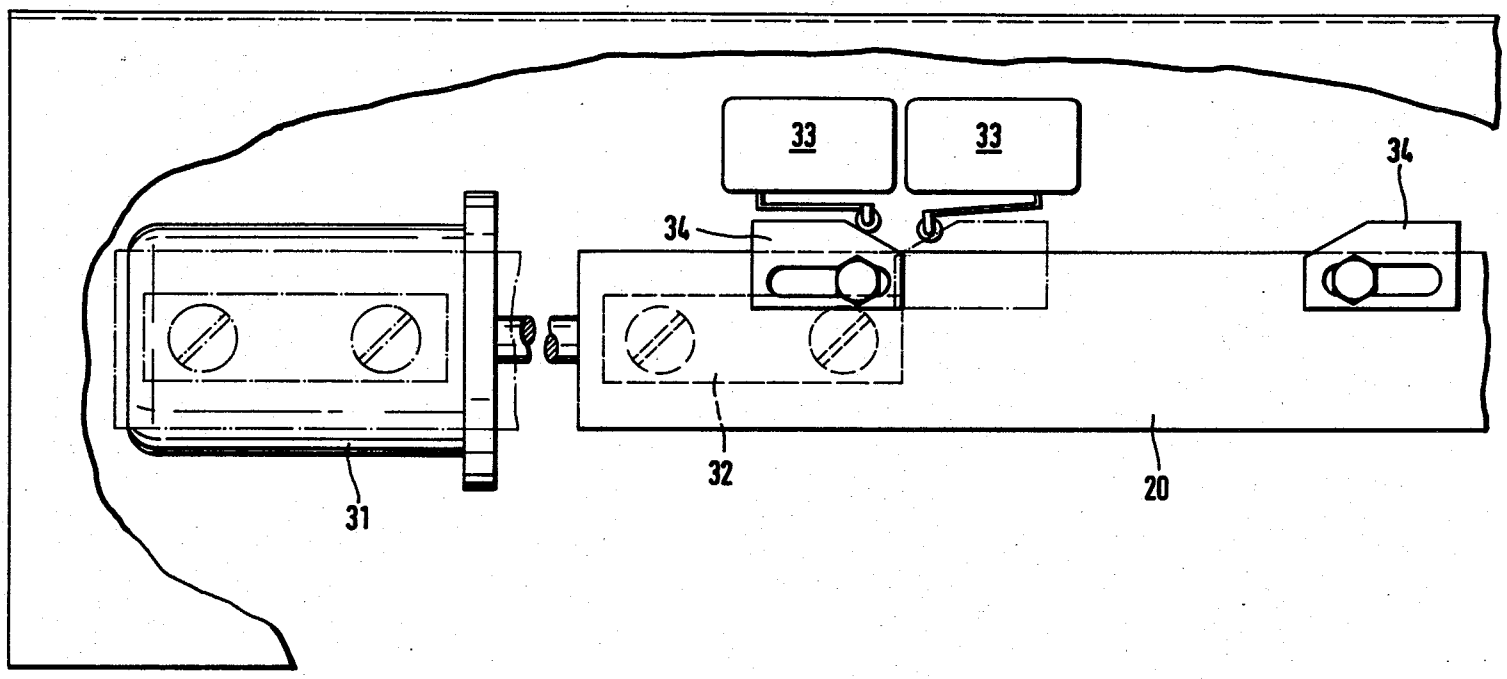
FIG. 4 is a fragmental illustration of the area IV of the spreader device indicated in FIG. 1.

FIG. 4 shows the driving part of the operating unit of the spreader device. An electrical driving motor 31 arranged beneath the plane of the drawing operates through an adjusting spindle, not shown in detail in FIG. 4, on a toothed clutch element 32 connected to one end of the changeover rod 20. Adjustably arranged on the end section of the changeover rod are abutment cams 34 cooperating with electrical end switches 33 and serving to limit the adjustment travel of the changeover bar 20 by switching off the motor 31.

Figure 5:
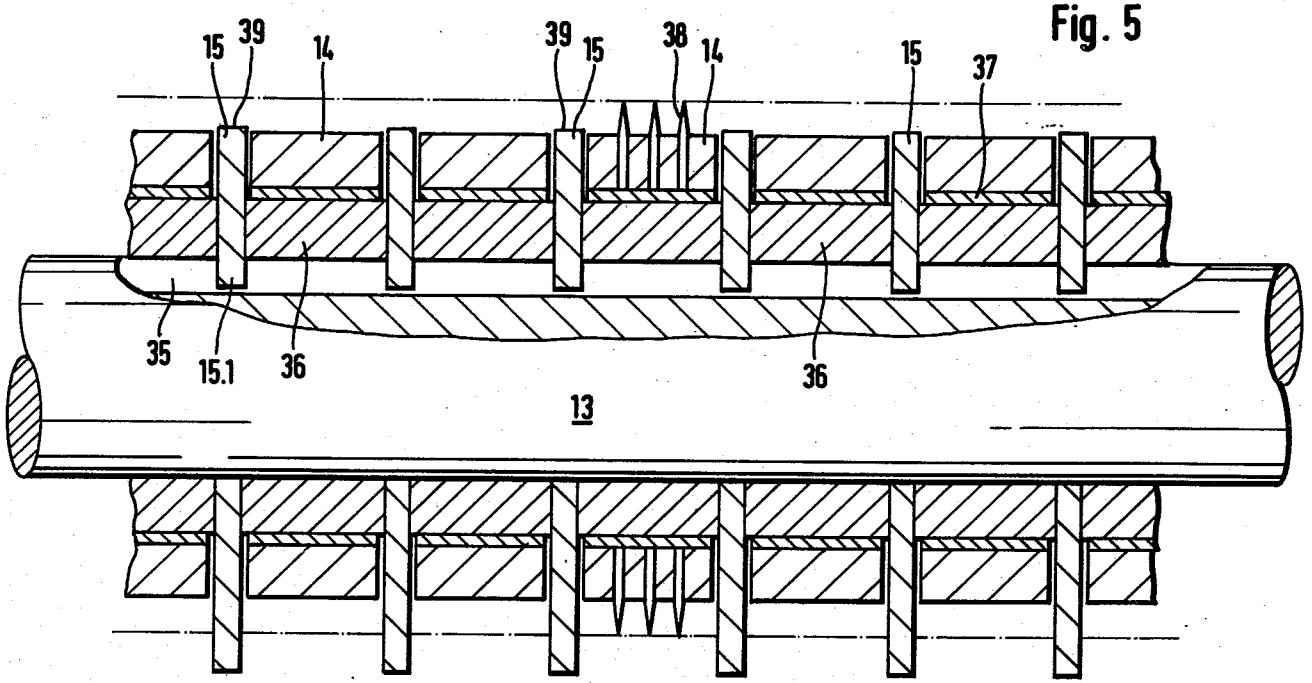
FIG. 5 is a central longitudinal section through a part of the support rod of the spreader device.

FIG. 5 shows the construction of the carrier rod 13 which extends over the full length of the needle beds. The carrier rod 13 is firmly connected to the retaining arms 16 and provided over its complete length with a groove 35 in which are engaged inner projections 15' of the relatively narrow dovetail shaped spacer discs 15.

The spacer discs 15 are provided with an eccentric inner through-bore. The relative spacing of the discs 15 is determined by bushes 36 pushed on to the carrier rod 13 and having freely rotatable thereon rollers 14 which are provided in the bore thereof with a bearing bush 37, these rollers being equipped with spikes 38. The spacing bushes 36 and the spiked rollers 14 are arranged concentrically on the carrier rod 13 between the eccentric intermediate discs 15. The eccentricity of the discs 15 is so chosen that the spikes 38 of the rollers 14 project outwards by only about half the height of the periphery over the smooth outer edges 39 of the discs 15, and in the remaining peripheral area are disposed retracted relatively to the superficial area defined by the smooth outer edges 39 of the spacer discs 15. The rigid carrier rod 13 is so arranged that the peripheral area exhibiting the spikes is that through which the knitted fabric 29 is taken down. Concentric spacer discs 15 and eccentric bushes 36 and rollers 14 could also be used.

We claim:

1. A knitted fabric spreader device for flat knitting machines having disposed beneath the comb gap defined between the two needle beds spiked rotatable rollers for taking down the knitted fabric by the take-down device of the machine, characterised by the fact that the spiked rollers (14) are arranged over a full length of the needle beds (10, 11) on a common carrier rod (13) which, for the purpose of clearing the comb gap (12) of the machine, is arranged for adjustment on the needle bed support frame (19) tranversely to the longitudinal direction of the needle beds (10, 11).

2. A knitted fabric spreader device according to claim 1, characterised by the fact that the carrier rod (13) is so mounted on the needle bed (10) that it will accompany this needle bed when the latter is racked.

3. A knitted fabric spreader device according to claim 1, characterised by the fact that the spiked roller (14) is mounted on the carrier rod (13) coaxially between eccentric spacer discs (15) with a flat peripheral edge (39) suchwise that spikes (38 of the rollers (14) only project radially beyond the discs (15) over a part of the periphery of the carrier rod (13) thereby to engage the knitted fabric (29).

4. A knitted fabric spreader device according to claim 1, characterised by the fact that the spikes (38) of the rollers (14) are disposed perpendicular to the axis of the carrier rod (13), which latter extends parallel to the comb gap (12) of the machine.

5. A knitted fabric spreader device according to claim 1, characterised by the fact that the carrier rod (13) is held on at least two slides (17) engaged in each case by a control cam body (21) for adjustment transversely to the longitudinal direction of the needle beds (10, 11).

6. A knitted fabric spreader device according to claim 1, characterised by the fact that its adjusting part has a changeover rod 820) which is longitudinally displaceable on the needle bed (10) and is coupled with an operating unit (23), which changeover rod is provided in the area of the slides (17) in each case with a cursor (21) with which a control cam (27) is designed to cooperate to produce the transverse adjustment.

7. A knitted fabric spreader device according to claim 6, characterised by the fact that the control cam (27) has at least one inactive part (27.1, 27.2) extending parallel to the longitudinal direction of the needle beds and of a length corresponding at least to the maximum length of racking of the needle beds.

8. A knitted fabric spreader device according to claim 1, characterised by the fact that slides (17) supporting the carrier rod (13) are arranged in bearings (24) anchored to the needle bed (10) and have adjusting bodies (40) engaging these bearings to provide for heightwise adjustment of the needle bed (10).

* * * * *